United States Patent [19]

Deis et al.

[11] Patent Number: 4,766,336

[45] Date of Patent: Aug. 23, 1988

[54] HIGH EFFICIENCY RAPID FIRE AUGMENTED ELECTROMAGNETIC PROJECTILE LAUNCHER

[75] Inventors: Daniel W. Deis, Churchill Boro; George A. Kemeny, Wilkins Township, Allegheny County; David W. Scherbarth, Wilkinsburgh, all of Pa.

[73] Assignee: Westinghouse Electric Corp., Pittsburgh, Pa.

[21] Appl. No.: 1,132

[22] Filed: Jan. 5, 1987

[51] Int. Cl.[4] ..... F41F 1/02

[52] U.S. Cl. ..... 310/12; 89/8; 124/3

[58] Field of Search ..... 310/12-14; 318/135; 89/8; 124/3

[56] References Cited

U.S. PATENT DOCUMENTS

| | | | |
|---|---|---|---|
| 4,319,168 | 3/1982 | Kemeny | 89/8 X |
| 4,343,223 | 8/1982 | Hawke et al. | 89/8 |
| 4,572,964 | 2/1986 | Honig | 89/8 X |
| 4,642,476 | 2/1987 | Honig | 89/8 X |
| 4,677,895 | 7/1987 | Carlson | 310/12 X |
| 4,714,003 | 12/1987 | Kemeny | 89/8 |

*Primary Examiner*—Patrick R. Salce
*Assistant Examiner*—D. L. Rebsch
*Attorney, Agent, or Firm*—D. Schron

[57] ABSTRACT

An electromagnetic parallel rail launcher with an augmentation winding for post-firing inductive energy recovery. A power supply includes a storage inductor which, in conjunction with the inductance of the augmenting winding, provides the inductive energy storage prior to firing. As the launcher projectile exits, the storage inductor is substantially decoupled from the rail and augmenting winding inductance, so that a high efficiency inductive energy transfer may be accomplished between the rails and augmenting winding.

15 Claims, 3 Drawing Sheets

HIGH EFFICIENCY RAPID FIRE AUGMENTED ELECTROMAGNETIC PROJECTILE LAUNCHER

BACKGROUND OF THE INVENTION

1. Field of the Invention

This invention in general relates to electromagnetic launcher systems, and particularly to a system which has an augmenting field and allows for more efficient recovery of the post-firing barrel bore inductive energy.

2. Description of the Prior Art

Basically, in an electromagnetic launcher, a power supply supplies energy to two elongated, generally parallel electrodes called projectile rails, and between which there is a bridging electrically conducting armature freely movable along the rails. When a high current is commutated into the rails at the breech end, resulting magnetic forces propel the armature down the rails, and with it, a projectile which exits the far end of the rails, the muzzle end, at the desired high velocities. Alternatively, current conduction across the projectile rails may be provided by a plasma which accelerates the projectile assembly, which includes a sabot against which the high pressure and high temperature plasma exerts the accelerating force.

In one type of electromagnetic launcher to be described hereinafter, a high DC current source in the form of a homopolar generator is brought up to a predetermined rotational speed, at which time the kinetic energy of the homopolar generator is transferred to a storage inductor prior to being supplied to the rails for firing.

In one type of rapid or burst firing arrangement, a plurality of augmenting windings adjacent the rails carry current in the same direction as the rails thereby reducing the rail current necessary to attain a predetermined propelling force. Advantageously, a large magnitude of inductive energy remains in the rails after a firing and a fraction of this inductive energy can be transferred back to the augmenting windings to conserve energy expenditure per shot and to shorten the time necessary for the current to next attain a certain firing level, so that efficient rapid fire may be accomplished.

The augmenting windings also function as a storage inductance for the buildup of inductive energy prior to current commutation. The more augmentation windings provided, the greater will be the inductive storage capacity. In a typical system, however, each augmentation winding has a mass equal to or even greater than that of the rails. If the system has a rail length on the order of 10 meters, just 3 pairs of augmenting windings can add tons to the overall weight of the system. This additional weight severely hampers many tactical uses of the launcher.

The augmenting windings are physically adjacent the rails so that they link the bore magnetic flux. If the number of augmenting windings is reduced, to reduce weight, and if a separate storage inductor is provided to substitute for the lost inductive energy storage capacity, then the post-firing inductive energy storage transfer efficiency is severely degraded, since the separate storage inductor represents stray inductance not in a flux linking relationship with the other windings.

The present invention allows for significant weight reduction by providing an extraneous storage inductor in conjunction with a reduced number of augmenting windings while still retaining a high efficiency post-firing energy transfer.

SUMMARY OF THE INVENTION

An electromagnetic launcher is provided and includes a source of high current and at least first and second inductors, with the second being in the form of an augmenting winding adjacent the rails of the launcher.

When the current through the inductors reaches a certain firing level the current is commutated into the rails, and as the launcher projectile exits, the rails are removed from the electrical circuit in a manner such that inductive energy remaining in the rails is inductively transferred to the second inductor. Means are provided for decoupling the first inductor from the second inductor during the inductor energy transfer, to provide for a significantly more efficient energy transfer.

DESCRIPTION OF THE PREFERRED EMBODIMENT

Figure 1:
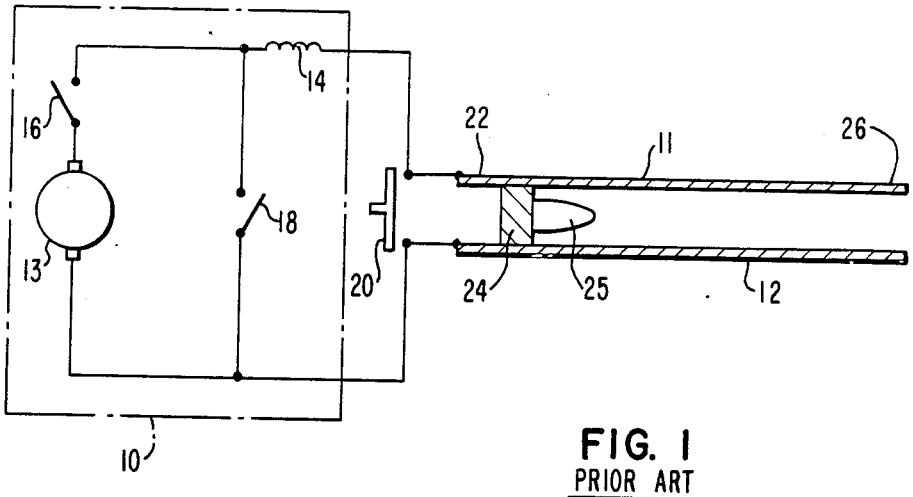
FIG. 1 PRIOR ART
FIG. 1 illustrates the basics of a typical prior art electromagnetic launcher.

Referring now to FIG. 1, there is illustrated a typical electromagnetic launcher system which includes a power supply 10 for supplying a high DC current to parallel electromagnetic launcher conductors, or projectile rails 11 and 12. The power supply includes a homopolar generator 13 driven or revved up by a prime mover (not illustrated). When the homopolar generator has attained a predetermined rotational speed, all or fraction of the kinetic energy thereof is transferred to a storage inductor 14 when switch 16 is closed. Energy is stored in the magnetic field of the inductor generated by current flowing therethrough and a low ohmic impedance allows for an extremely large inductive energy storage capacity at a relatively low charging voltage. The arrangement enables relatively low power input to build up and store a large magnitude of pulse power by storing the energy first in a rotating mass, and then all or a fraction of it in an electromagnetic field.

Some systems include a switch 18 known as a crowbar switch which, in the event of a malfunction, or even in normal firing, will isolate the homopolar generator from the firing circuit before or after the inductor 14 has been charged, and may safely help to dissipate the system energy.

During the charging cycle, switch 20 connected to the breech end 22 of rails 11 and 12 remains in a closed condition. When the inductor current magnitude reaches an appropriate firing level, switch 20 is opened and current is commutated into rails 11 and 12, bridged by movable conducting armature 24. Current flows down one rail, through the armature and back along the other rail such that the current flowing in the loop exerts a force on the armature 24 to accelerate a projectile 25. The accelerating force in essence is a function of the magnetic flux density and current density, and since the current flowing in the rails is often 1.5 million amperes or more, the projectile 25 exits the muzzle end 26 of the rail system at an exceptionally high velocity measurable in many km/sec.

Figure 2:
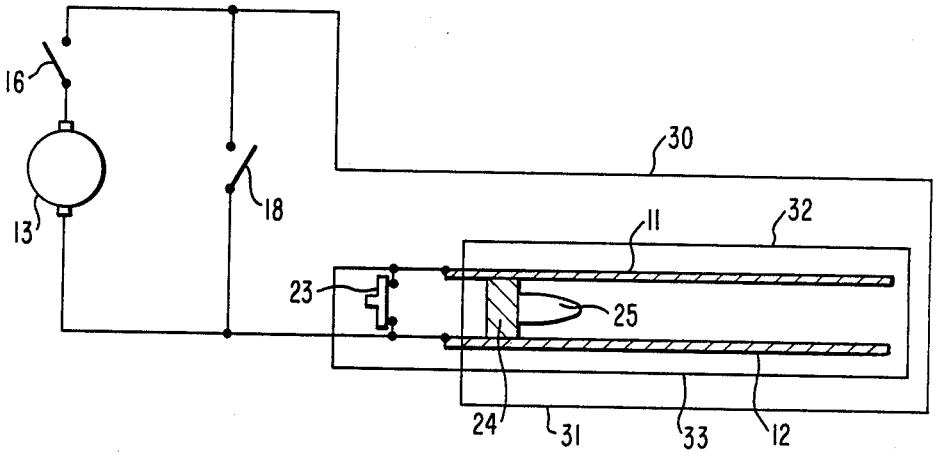
FIG. 2 PRIOR ART
FIG. 2 illustrates a prior art launcher system which includes augmenting windings.

FIG. 2 illustrates another type of prior art system which includes augmenting windings and is the subject matter of copending allowed application, Ser. No. 256,745, filed Apr. 23, 1981 and assigned to the same assignee as the present invention.

In the arrangement of FIG. 2, inductive energy storage is accomplished with the provision of a plurality of augmenting windings of which two 30,31 and 32,33 are illustrated. When the current in the augmenting windings has built up to a desired firing level, switch 23 is opened and the current is commutated into the rails as in FIG. 1. Current flow in windings 30 and 32 is in the same direction as current flow in rail 11 and current flow in augmenting windings 31 and 33 is in the same direction as current in rail 12 such that the initial magnetic field is augmented to allow for a greater acceleration force and a shorter rail or barrel length to attain a given velocity.

The rails may have a resistive portion near the muzzle end and when the armature 24 is in the vicinity of this resistive portion, switch 23 is again closed forming a closed loop consisting of switch 23, rails 11 and 12 and the armature 24, or after the armature exit, by an arc which is struck at the muzzle or by current flowing through a muzzle shunting means. A considerable magnitude of inductive energy is stored in this loop as well as in mutual inductance after the projectile exit and since windings 30,31 and 32,33 substantially link the same flux as the rail inductive loop, an efficient current and energy transfer from the rail loop back to the augmenting winding loops will occur and is driven by the ohmic voltage drop in the rails, in the rail resistive portions, plus the muzzle arc voltage drop.

The energy transfer between flux linking turns can be essentially instantaneous, however, if any stray inductance is present, time and energy will be expended to inject current into the stray inductance. The presence of a storage inductor such as 14 in FIG. 1 would represent a large stray inductance which would result in a serious energy loss for post-firing energy recovery and accordingly for the embodiment of FIG. 2, such a storage inductor should not be used. The consequence of the elimination of the storage inductor is the requirement for a plurality of augmenting windings which result in a massive configuration, since the augmenting windings are at least equal to, and in most instances are of greater mass than, the conducting rails themselves. The present invention, one embodiment of which is illustrated in FIG. 3, allows for the inclusion of a storage inductor 14 as well as a reduction in the number of augmenting windings utilized, with a consequent reduction in overall barrel weight and additionally results in efficient barrel loop energy recovery.

Figure 3:
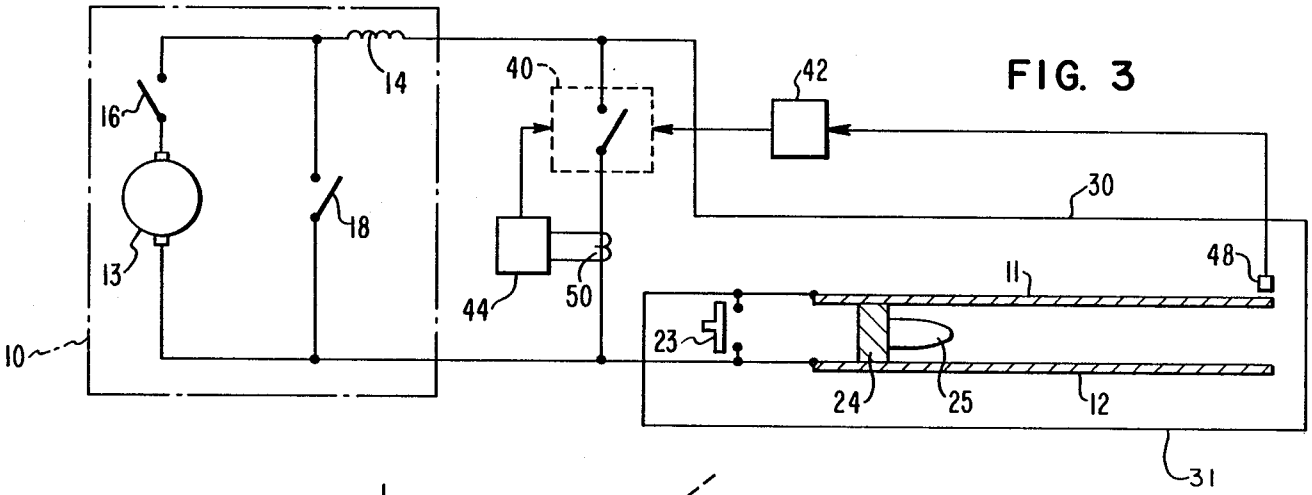
FIG. 3 illustrates one embodiment of the present invention.

FIG. 3 illustrates the rails 11 and 12 in conjunction with a single augmenting winding 30,31. The arrangement includes a low impedance short circuiting switch means 40 connected across the power supply 10 and being operable to close in response to a signal from actuator or circuitry 42 and to reopen in response to a signal from actuator 44. As will be explained, the closing of switch means 40 takes place when the armature 24 and projectile are in the vicinity of the muzzle end of the rail system. One way of effecting closure of the switch means 40 is by the inclusion of a sensor 48 which senses the presence of the armature and/or projectile 24/25 at the muzzle end and provides an appropriate signal to actuator 42 for effecting switch closure. The closure could also be effected automatically a predetermined time after firing. Reopening of the switch means preferably occurs when current through it is zero and this may be effected with the presence of a current sensor 50 providing the necessary signal to reopening actuator or circuitry 44.

Figure 4A:
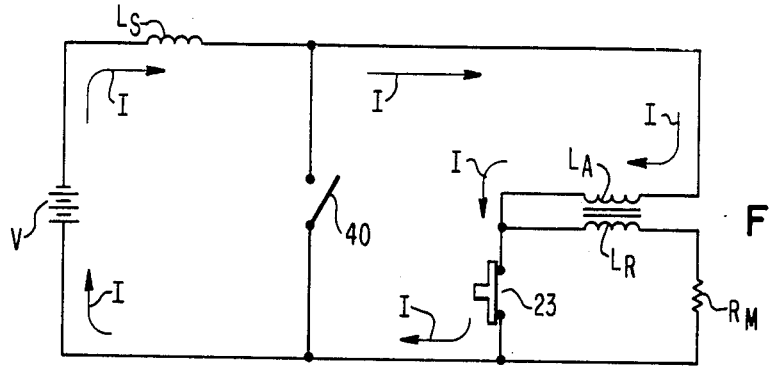
FIGS. 4A to 4D are simplified circuit equivalents of the embodiment illustrated in FIG. 3 to illustrate switch positions during operation.

Operation of the embodiment illustrated in FIG. 3 will now be explained with additional reference to FIGS. 4A through 4D and FIG. 5. FIG. 4A illustrates a simplified equivalent circuit form of the arrangement in FIG. 3 and includes a battery V for providing an output current equivalent to the homopolar generator. $L_S$ represents the inductance of storage inductor 14, $L_A$ represents the self inductance of augmentation windings 30,31, $L_R$ represents the self inductance of the rails 11 and 12 and $R_M$ represents rail and muzzle resistance. With switch 23 in a closed position and switch 40 in an open position, the current in the circuit is as represented by the arrows I.

Figure 5:
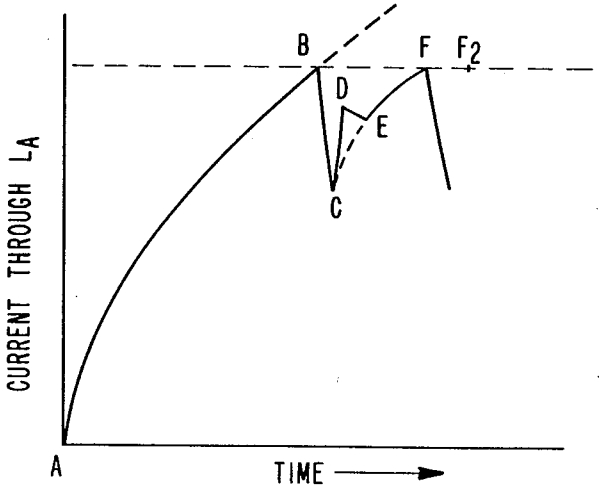
FIG. 5 is a curve illustrating operation of the present invention.
Figure 4B:
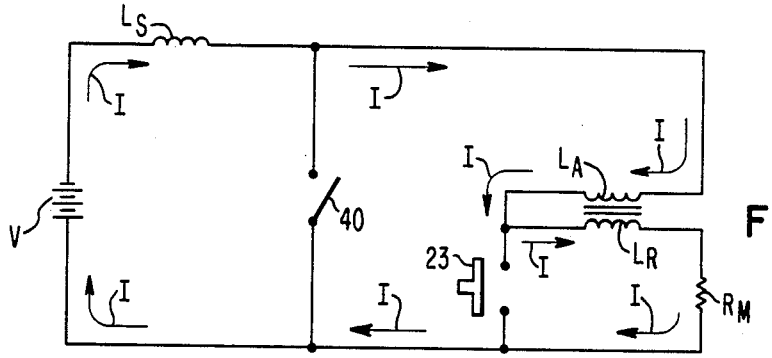
Figure 4C:
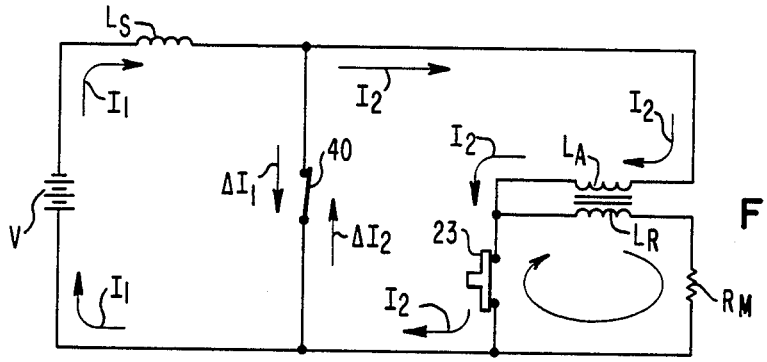

The buildup of current through $L_A$ to a certain firing level is represented by the curve from A to B in FIG. 5. At point B, firing occurs by opening switch 23, as illustrated in FIG. 4B, thus commutating the current into the rails to accelerate the projectile. During firing, the current in a few milliseconds drops to a muzzle current level at point C and at projectile exit or just prior thereto, switch 23 is closed as is switch 40, the condition being represented in FIG. 4C.

At projectile exit, a muzzle arc forms and the muzzle arc voltage drop in conjunction with current through the rail resistance creates a voltage which efficiently injects the post-firing rail inductive and mutual inductive energy into the inductance $L_A$ to thereby increase the current in $L_A$, as indicated by the curve from point C to D in FIG. 5. This incremental increase in current, $\Delta I_2$, will not be injected at high energy loss to flow through $L_S$ but rather, by virtue of the closure of switch 40, will practically all flow through short circuiting switch means 40 in the direction indicated in FIG. 4C. Concurrently, the homopolar generator is increasing the current through $L_S$ to get ready for the next firing, and this current is represented by the current loop $I_1$. The incremental current rise in the homopolar generator and $L_S$ loop, $\Delta I_1$, will again practically all flow through the short circuiting switch means 40 in the direction shown in FIG. 4C. Therefore, a net current $\Delta I = \Delta I_2 - \Delta I_1$ flows through switch 40.

Figure 4D:
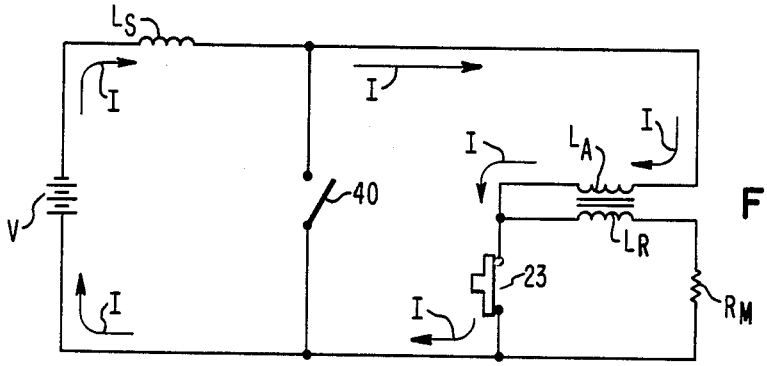

After the projectile rail energy recovery, the current through $L_A$ decays in a manner of an L-R circuit along the curve from point D to E. During this time, current $I_1$ is increasing as indicated by the dotted portion of the curve from point C to E in FIG. 5 and at a rate faster than the initial increase from A to B due to the fact that the current is being injected into only one inductor, due to the decoupling function of switch 40. When $\Delta I$ through switch 40 is zero or approximately zero, that is, $I_2 = I_1$, switch 40 is near losslessly reopened, as indicated in FIG. 4D, so that the current through $L_A$ commences rising to the firing level for the next shot, as represented by the curve from point E to F in FIG. 5, whereupon the next firing may take place, the process being in the order of tens of milliseconds between firings. Absent the efficient energy recovery procedures, firing of the second shot would occur at a later time for example at $F_2$ and at higher energy expenditure per shot.

Accordingly, with the arrangement of the present invention, switch 40 decouples the storage inductance from the augmenting winding inductance such that the storage inductance is disassociated from the post-firing energy transfer between the mutual flux linking rail and augmenting winding inductances, and without which disassociation, the energy transfer would be severely degraded.

What is claimed is:

1. An electromagnetic projectile launcher, comprising:

(A) a source of high current including a storage inductor;

(B) a pair of conducting launcher rails;

(C) means for conducting current between said rails and for propelling a projectile along said rails;

(D) at least one bore flux augmenting winding connected in series with said current source;

(E) switch means for switching current into said rails from said storage inductor and augmenting winding;

(F) said augmenting winding and said rails being in close proximity to one another to be in flux linking relationship for transfer of inductive energy from said rails to said augmenting winding as said projectile exits said rails; and (G) decoupling means for decoupling said storage inductor from said augmenting winding during said inductive energy transfer.

2. Apparatus according to claim 1 wherein:

(A) said augmenting winding includes (i) a first conductor parallel to a first of said rails and oriented to conduct current in the same direction as said first rail, and (ii) a second conductor parallel to the second of said rails and oriented to conduct current in the same direction as said second rail.

3. Apparatus according to claim 1 wherein:

(A) said decoupling means includes a second switch means electrically interconnected to provide a temporary short circuit path which allows efficient and substantially independent current increase in the storage inductor and also in said augmenting windings.

4. Apparatus according to claim 3 wherein:

(A) said second switch means is operable to close as said projectile exits said rails and to reopen when the net current through said second switch means is essentially zero.

5. Apparatus according to claim 3 which includes:

(A) means for providing a first output signal as said projectile exits said rails;

(B) means responsive to said first output signal for closing said second switch means;

(C) means for subsequently opening said second switch means.

6. Apparatus according to claim 5 wherein:

(A) said second switch means is subsequently opened when the net current therethrough is essentially zero.

7. Apparatus according to claim 6 which includes:

(A) means for providing a second output signal when said net current is essentially zero; and (B) means responsive to said second output signal for opening said second switch means.

8. An electromagnetic projectile launcher comprising:

(A) first and second conducting rails;

(B) means for conducting current between said rails and for propelling a projectile along said rails;

(C) a source of high current including a first inductor;

(D) a second inductor in the form of a winding having a first conductor adjacent said first rail and a second conductor adjacent said second rail;

(E) first switch means;

(F) said inductors and switch means being electrically connected to said current source in a manner that the current in the electrical circuit so constituted charges up to a predetermined firing level at which time said first switch means is operable to commutate said charging current into said rails to launch said projectile;

(G) said first switch means being thereafter operable at a predetermined point in said launch to isolate said rails from said circuit whereby inductive energy remaining in said rails is inductively coupled and transferred to said second inductor;

(H) second switch means connected in circuit to both said first and second inductors and operable such that, during said inductor energy transfer, charging current increase from said current source flows essentially through only said first inductor and through said second switch means and current increase in said second inductor flows essentially through only said second inductor and said second switch means.

9. Apparatus according to claim 8 wherein:

(A) said first conductor is parallel to, and carries current in the same direction as, said first rail;

(B) said second conductor is parallel to, and carries current in the same direction as, said second rail.

10. Apparatus according to claim 9 wherein:

(A) said first and second conductors are substantially coextensive with said first and second rails.

11. Apparatus according to claim 1 wherein:

(A) no more than one augmenting winding is provided.

12. Apparatus according to claim 1 wherein:

(A) said high current source includes a homopolar generator.

13. A method of operating an electromagnetic projectile launcher which has a high current source, including a storage inductor, for supplying current to a pair of conducting rails between which a bridging armature is propelled along the rails, comprising the steps of:

(A) providing an augmenting winding adjacent said rails, in electrical circuit with said storage inductor, to recover post-firing inductive energy;

(B) temporarily decoupling said storage inductor from said augmenting winding during said post-firing inductive energy recovery to allow efficient current increase substantially independently in said storage inductor and in said augmenting winding.

14. The method of claim 13 in which the step of temporarily decoupling includes the step of:

(A) providing a temporary shorted path through which substantially the total incremental current increases in said storage inductor and in said augmenting winding are conducted in opposite directions.

15. The method of claim 14 which includes the step of:

(A) opening said shorted path when said incremental increases are substantially equal.

* * * * *